United States Patent [19]

Hertel

[11] Patent Number: 4,527,846

[45] Date of Patent: Jul. 9, 1985

[54] ZOOM FOCUS AND DEFLECTION ASSEMBLY FOR ELECTRON DISCHARGE DEVICES OF THE CAMERA TUBE TYPE

[75] Inventor: Richard J. Hertel, Ft. Wayne, Ind.

[73] Assignee: International Telephone and Telegraph Corporation, New York, N.Y.

[21] Appl. No.: 372,506

[22] Filed: Apr. 28, 1982

[51] Int. Cl.[3] ..... H01J 29/58

[52] U.S. Cl. ..... 315/382; 313/382; 313/381

[58] Field of Search ..... 315/382, 382.1; 313/381, 382; 336/212

[56] References Cited

U.S. PATENT DOCUMENTS 3,295,010 12/1966 Clayton ..... 313/381

3,686,527 8/1972 Gabor ..... 315/382

*Primary Examiner*—Theodore M. Blum

*Assistant Examiner*—Gregory C. Issing

*Attorney, Agent, or Firm*—John T. O'Halloran; Peter R. Ruzek

[57] ABSTRACT

The zoom focus and deflection assembly for an image-to-electron beam converting electron discharge device comprises a magnetic deflection yoke and a magnetic electron beam focusing coil having N sections each having its own adjustable current source such that at least the opposite end ones of the N sections have the magnitude of current therethrough changed simultaneously in the opposite direction, where N is an integer greater than one.

23 Claims, 4 Drawing Figures

Fig. 1
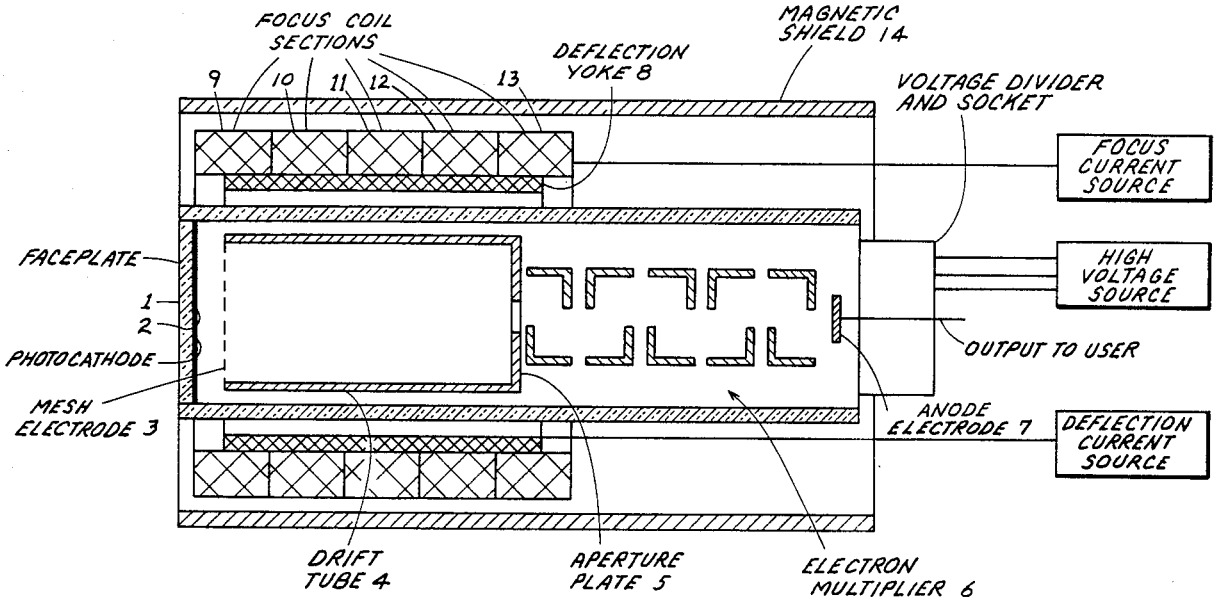
Fig. 2
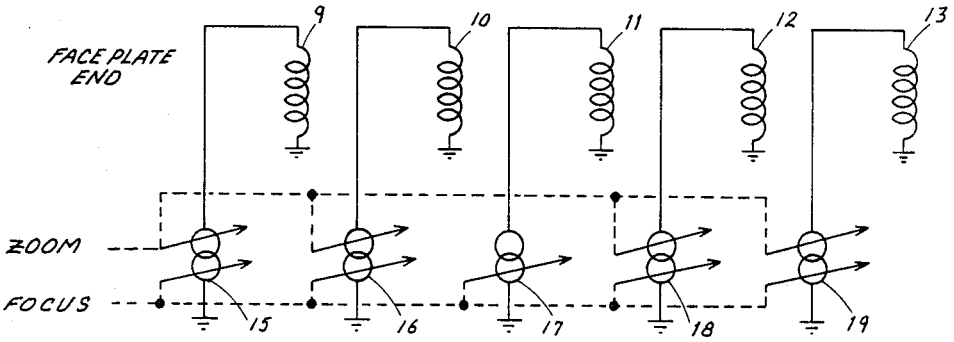
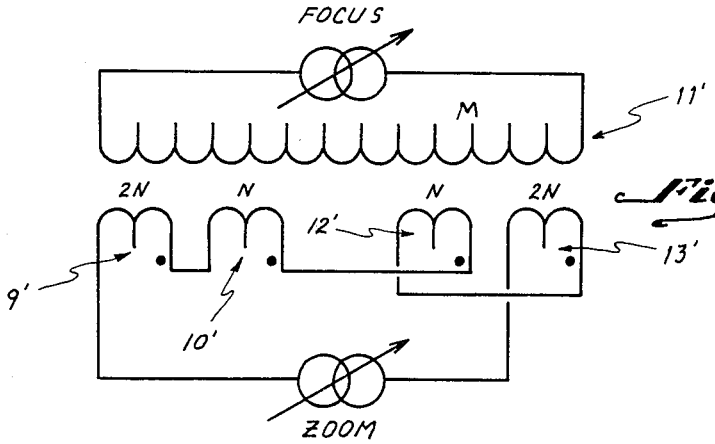
Fig. 3

ZOOM FOCUS AND DEFLECTION ASSEMBLY FOR ELECTRON DISCHARGE DEVICES OF THE CAMERA TUBE TYPE

BACKGROUND OF THE INVENTION

The present invention relates to electron discharge devices of the camera tube type and more particularly to a zoom focus and deflection assembly for such electron discharge devices.

Focus and deflection assemblies are electron optical devices used to provide the magnetic fields needed to operate image dissector tubes and other electron discharge devices of the camera tube type including vidicons, orthicons, other types of television pickup camera tubes, variable magnification image intensifier and image converter tubes.

In general a focus and deflection assembly includes three wire wound coils or, in some cases, printed circuit conductors, arranged so that the axis of each coil is orthogonal to the other two coil axes. The three coils may be, or may not be contained within a magnetic shield.

The usual construction practice has two saddle wound deflection yokes contained within a solenoid focus coil. There are cases where the innermost coil is the focus solenoid and the deflection yokes are on the outside.

The focus coil provides a magnetic field oriented essentially parallel to the tube axis of rotational symmetry. Focus coils typically have a 2:1 to 5:1 length to diameter ratios and provide fields of 2 to 5 mT (millitesla) when used with vidicons or image dissectors. This field, in conjunction with the electrostatic potentials in the tube focuses the flow of electrons from the gun to target in a vidicon or from the photocathode to the aperture in the image dissector.

The deflection yokes act orthogonal to the focus field and are typical 1/10 or less the strength of the focus field. The deflection fields cause the electron beam of a vidicon to scan the target and cause the image to move with respect to the sampling aperture in an image dissector.

In present image dissector tubes and deflection assemblies, the sampling aperture is selected at the time of tube construction. The sampling aperture size can be changed only by substituting another tube or by using expensive tubes having multiple apertures. In neither case can the size of the aperture be smoothly and continuously adjusted. Multi-aperture tubes are subject to cross talk between apertures.

Deflection assemblies used with image dissectors exhibit non-linear deflection in terms of current versus position in the image.

SUMMARY OF THE INVENTION

An object of the present invention is to provide an electron discharge device of the camera tube type overcoming the above method disadvantages of the prior art.

Another object of the present invention is to provide a zoom focus and deflection assembly that can smoothly and continuously adjust the size of the aperture in image dissector tubes.

A further object of the present invention is to provide a zoom focus and deflection assembly that enables a continuous adjustment of the resolution of an image-to-electron beam converting electron discharge device.

A feature of the present invention is the provision of a zoom focus and deflection assembly for an image-to-electron beam converting electron discharge device having a given resolution, comprising magnetic deflection means disposed about, along and coaxial of the device; magnetic electron beam focusing means disposed along and in a predetermined relationship with the deflection means and the device and having a predetermined distribution of ampere turns therealong; and adjustable current supply means coupled to the focusing means to enable continuous adjustment of the predetermined distribution of the ampere turns and, hence, a continuous adjustment of the given resolution.

BRIEF DESCRIPTION OF THE DRAWING

Above-mentioned and other features and objects of this invention will become more apparent by reference to the following description taken in conjunction with the accompanying drawing, in which:

FIG. 1 is a longitudinal cross-sectional view of an image dissector tube incorporating the zoom focus and deflection assembly in accordance with the principles of the present invention;

FIG. 2 is a schematic illustration of one embodiment of the zoom coil and focus current sources in accordance with the principles of the present invention;

FIG. 3 is a schematic illustration of a second embodiment of the zoom coil and focus current sources in accordance with the principles of the present invention.

DESCRIPTION OF THE PREFERRED EMBODIMENTS

Figure 4:
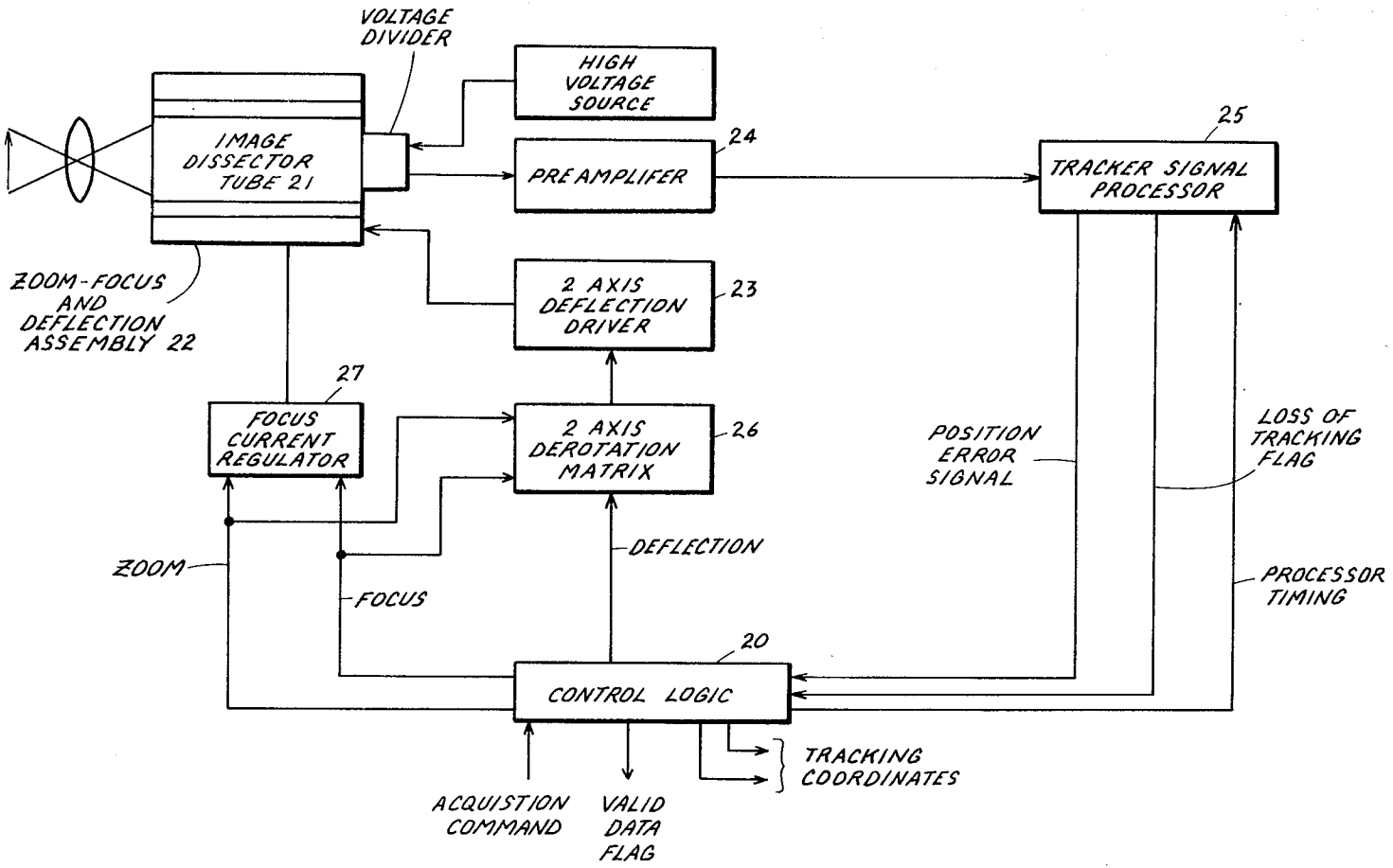
FIG. 4 is a block diagram of a conventional star tracker employing an image dissector and zoom focus and deflection assembly in accordance with the principles of the present invention.

The zoom focus and deflection assembly of the present application will be described in connection with an image dissector. However, it is to be understood that this description in no way limits the application of the disclosed zoom focus and deflection assembly to an image dissector; rather, such assembly may be employed with any electron discharge device of the camera tube type wherein an image is converted to an electron beam.

The image dissector of FIG. 1 is that type of image dissector disclosed in U.S. Pat. No. 3,295,010 and includes a faceplate 1 having a photocathode 2 deposited on the inner surface of the faceplate 1. Adjacent to the photocathode 2 is a mesh electrode 3 at the entrance of a drift tube 4 with the drift tube 4 having at the output end thereof an aperture plate 5. The components thus far disclosed constitute the imaging section of the electron discharge device. An electron multiplier 6 and anode electrode 7 providing an output to a user completes the construction of the image dissector of FIG. 1.

The zoom focus and deflection assembly of the present invention is conventional in the sense that the focus solenoid is outside the deflection yoke 8. The focus solenoid is made in five sections 9–13, each about 1/5 the length of a standard focus coil. Five sections are chosen for reasons of performance and convenience. Any number could be used except that less than four sections is likely to be too coarse and leading to less zoom range or more distortion. Greater than five sections provides a better coil but is also more complex to use.

When a magnetic field from the focus coil is present, the electron version of the optical image is focused onto the aperture plate 5.

A magnetic shield 14 completes the assembly but is not mandatorily present in such an assembly.

Each of the five sections 9–13 is powered by its own current source of regulator. The focus current sources or regulators are adjusted by only two controls. One control "focus" adds or substracts the same amount of current from each section with each section having the same number of turns. The other control called "zoom" will add current to one end section 9 while subtracting the same amount of current from the opposite end section 13. The "zoom" control has the same effect on the next two sections 10 and 12 except that the change in current is ½ that of sections 9 and 13. This is illustrated schematically in FIG. 2 wherein the current sources are current sources 15–19 with sources 15 and 19 generating twice the amount of current change per increment of zoom control change than do generators 16 and 18.

It would be possible to gang the "zoom" and "focus" controls to minimize any focus shift that occurs during the zoom operation.

It should be noted that the "zoom" control has no effect upon the center section 11 of the focus coil.

Illustrated in FIG. 3 is another possibility of the zoom focus coil wherein the distribution of turns varies along the length of the coil and wherein only two current regulators are required. Five windings are shown. Winding 11' is of length L and of conventional design. Windings 9' and 13' are each of length L/5 and have 2N turns. Windings 10' and 12' are also of length L/5 but have only N turns. This arrangement allows coils 9', 10', 12' and 13' to be connected in series as illustrated using one current regulator source for the zoom adjustment.

The zoom focus and deflection assembly described in connection with FIGS. 1–3 can be employed in a conventional star tracker illustrated in FIG. 4 which includes a command and control module which sequences the tracker operation.

Upon receipt of an acquisition command at control logic 20, the tracker, by means of the image dissector tube 21 and its associated zoom focus and deflection assembly 22, begins a search of the field of view. The search is by scanning the area of interest via deflection signals to the yoke winding of assembly 22 via the two axis deflection driver 23. The preamplifier 24 sends any detected signal to tracker signal processor 25 where it is analyzed for a trackable target signal. If found, a track flag alerts control logic 20 and the logic 20 switches to track mode.

The outputs from logic 20 are the coordinates of the target being tracked and the tracker status.

When a zoom coil is used as described hereinabove, control logic 20 commands, via the zoom signal, a circuit coil current that gives a large effective aperture at the photocathode during the search mode of operation. The two axis derotation matrix 26 moves any incidental image rotation and deflection scale factor changes.

After acquisition, the control logic 20 commands via the zoom control and through focus current regulator 27, a small fixed aperture at the photocathode. This is used during tracking to minimize background interference with the target signal.

In many image dissector camera applications it would be very useful if the camera could trade resolution and signal to noise ratio. A large aperture at aperture plate 5 provides high signal to noise ratio and low resolution while a small aperture provides low signal to noise ratio and high resolution. Usually the trade is necessary because the illumination is constant. Until the advent of the zoom coil as described herein, selected resolution was possible only with special multi-aperture tubes which are expensive. The ability to use a standard tube of the approximately optimum aperture size with a zoom coil to adjust this aperture size is a cost and time saver. It is much less expensive to get selectable aperture size in an image dissector using the zoom focus assembly as described herein than either multi-aperture tubes or electrostatic zoom focus lenses.

The technique described herein can be employed to match the format of a high resolution telescope to electronic detectors such as charge coupled devices. The telescope pixels can be approximately 5 to 10 micrometers. The charge coupled devices pixels are more like 15 to 25 micrometers. Efficiency of information detection would require the matching of these two pixel sizes. The match can be obtained using image intensifier tubes, a zoom focus coil and a fixed magnification and a charge coupled device. This scheme offers the added features of low noise gain ahead of the charge coupled device and wavelength conversion, e.g., ultraviolet to visible. As can be seen from the foregoing, the present invention changes the distribution of the ampere turns along the focus coil to change the magnetic flux density along the length of the tube. A conventional assembly has approximately the same flux density at the photocathode tube as at the aperture 5 of an image dissector. If the flux density at the aperture is increased, the effective aperture diameter at the photocathode increases and the tube resolution is decreased. Reverse the flux conditions and the effective aperture diameter decreases and the tube resolution increases. Since the control is by means of changes in currents in the focus coil sections, the means is electronic and smoothly variable. A range of 2.8:1 in the effective size of the aperture at the photocathode has been observed. As a secondary feature, the changed ampere turns distribution affects the deflection non-linearities. When the fields are arranged for large aperture at the photocathode the distortion becomes 2.5 to 6%. When the magnetic fields are arranged for a small aperture at the photocathode the deflection distortion becomes 0.15 to 0.2%.

Therefore, almost all coil parameters, such as distortion, orthogonality, and dynamic focus, improve as the zoom control serves to reduce the effective aperture size at the photocathode.

It should be noted that more sections could be added to the focus coil and that the focus coil could be made longer or shorter. In addition, the focus coil could go inside the deflection yoke 8 and the non-uniformity could be in the number of turns in each section since the number of turns and current product is all that counts in the present invention.

The following applications of the techique disclosed herein are possible:

1. Variable magnification image dissector tube and coil sets.
2. Image dissector camera using Number 1 above.
3. Star trackers using Number 2 above. The large aperture mode is used for coarse scan during acquisition while the small aperture mode, low distortion and high resolution mode is used for precision tracking.

4. Variable magnification image intensifier and image converter tubes.
5. Tubes as in Number 4 above but containing electron bombarded silicon diode arrays, charge coupled devices, charge injection devices, etc. where it is desirable to match the optical input pixel size to the semiconductor pixel size.
6. Tubes as in Number 5 above but using phosphor screen and fiber optic coupling to the semiconductor or to film.
7. Operation of the ITT Correlaetron ® tube to give variable magnification and rotation.

While I have described above the principles of my invention in connection with specific apparatus, it is to be clearly understood that this description is made only by way of example and not as a limitation to the scope of my invention as set forth in the objects thereof and in the accompanying claims.

I claim:

1. A zoom focus and deflection assembly for an image-to-electron beam converting electron discharge device having a given resolution comprising:

magnetic deflection means disposed about, along and coaxial of said device;

magnetic electron beam focusing means disposed along and in a predetermined relationship with said deflection means and said device and having a predetermined distribution of ampere turns therealong; and adjustable current supply means coupled to said focusing means and operative for causing continuous simultaneous adjustment of said predetermined distribution of said ampere turns in opposite directions from the central region toward the respective end regions of said focusing means independently of the operation of said deflection means and, hence, continuous adjustment of said given resolution.

2. An assembly according to claim 1, wherein said focusing means includes N coil sections disposed along said device, where N is an integer greater than one.

3. A zoom focus and deflection assembly for an image-to-electron beam converting electron discharge device having a given resolution comprising:

magnetic deflection means disposed about, along and coaxial of said device;

magnetic electron beam focusing means disposed along and in a predetermined relationship with said deflection means and said device and having a predetermined distribution of ampere turns therealong, including N coil sections disposed along said device, where N is an integer greater than one, each of said N sections having the same number of turns; and adjustable current supply means coupled to said focusing means to enable continuous adjustment of said predetermined distribution of said ampere turns and, hence, a continuous adjustment of said given resolution, including N current sources each coupled to a different one of said N sections, and at least a first common control coupled to selected ones of said N sources to change the magnitude of current through at least opposite ends ones of said N sections simultaneously in the opposite direction.

4. An assembly according to claim 3, wherein said supply means further includes a second common control coupled to each of said N current sources to change the magnitude of current through each of said N sections simultaneously in the same direction.

5. An assembly according to claim 4, wherein said first common control simultaneously changes the magnitude of current through those of said N sections next to said opposite end ones of said N sections simultaneously in the opposite direction by an amount equal to one half the magnitude of current change of said opposite end ones of said N sections.

6. An assembly according to claim 3, wherein said first common control simultaneously changes the magnitude of current through those of said N sections next to said opposite end ones of said N sections simultaneously in the opposite direction by an amount equal to one half the magnitude of current change of said opposite end ones of said N sections.

7. A zoom focus and deflection assembly for an image-to-electron beam converting electron discharge device having a given resolution comprising:

magnetic deflection means disposed about, along and coaxial of said device;

magnetic electron beam focusing means disposed along and in a predetermined relationship with said deflection means and said device and having a predetermined distribution of ampere turns therealong, including N coil sections disposed along said device, where N is an integer greater than one, each of said N sections having the same number of turns, N being equal to five; and adjustable current supply means coupled to said focusing means to enable continuous adjustment of said predetermined distribution of said ampere turns and, hence, a continuous adjustment of said given resolution, including five current source each coupled to a different one of said five sections, and at least a first common control coupled to at least the first and fifth ones of said five sources to change the magnitude of current through the first and fifth ones of said five sections simultaneously in the opposite direction.

8. An assembly according to claim 7, wherein said supply means further includes a second common control coupled to each of said five sources to change the magnitude of current through each of said five sections simultaneously in the same direction.

9. An assembly according to claim 8, wherein said first common control simultaneously changes the magnitude of current through the second and fourth of said five sections simultaneously in the opposite direction by an amount equal to one half the magnitude of current change of the first and fifth ones of said five sections.

10. An assembly according to claim 7, wherein said first common control simultaneously changes the magnitude of current through the second and fourth of said five sections simultaneously in the opposite direction by an amount equal to one half the magnitude of current change of the first and fifth ones of said five sections.

11. An assembly according to claim 2, wherein $(N-1)$ of said N sections are connected in series, the opposite end ones of said (N−1) sections have twice the number of turns as the others of said (N−1) sections, and said supply means includes a first adjustable current source coupled to said (N−1) sections to change the magnitude of current through at least the opposite ends ones of said (N−1) sections simultaneously in the opposite direction.

12. An assembly according to claim 11, wherein said supply means further includes a second adjustable current source coupled to the remaining one of said N sections to change the magnitude of current through said remaining one of said N sections.

13. An assembly according to claim 12, wherein said first current source simultaneously changes the magnitude of current through those of said (N−1) sections next to said opposite end ones of said (N−1) sections simultaneously in the opposite direction.

14. An assembly according to claim 11, wherein said first current source simultaneously changes the magnitude of current through those of said (N−1) sections next to said opposite end ones of said (N−1) sections simultaneously in the opposite direction.

15. A zoom focus and deflection assembly for an image-to-electron beam converting electron discharge device having a given resolution comprising:

magnetic deflection means disposed about, along and coaxial of said device;

magnetic electron beam focusing means disposed along and in a predetermined relationship with said deflection means and said device and having a predetermined distribution of ampere turns therealong, including N coil sections disposed along said device, where N is an integer greater than one, N being equal to five, one of said five sections having a given length L and four of said five sections each having a length of L/5 and being connected in series to each other, the first and fourth ones of said four of said five sections having twice the number of turns as the second and third ones of said four of said five sections; and adjustable current supply means coupled to said focusing means to enable continuous adjustment of said predetermined distribution of said ampere turns and, hence, a continuous adjustment of said given resolution, including a first current source coupled to said four of said five sections to change the magnitude of current through at least the first and fourth ones of said four of said five sections simultaneously in the opposite direction.

16. An assembly according to claim 15, wherein said supply means further includes a second adjustable current source coupled to said one of said five sections to change the magnitude of current through said one of said five sections.

17. An assembly according to claim 16, wherein said first current source simultaneously changes the magnitude of current through the second and third of said four of said five sections simultaneously in the opposite direction.

18. An assembly according to claim 15, wherein said first current source simultaneously changes the magnitude of current through the second and third of said four of said five sections simultaneously in the opposite direction.

19. An assembly according to claims 1, 2, 3, 4, 5, 6, 11, 12, 13 or 14, wherein said deflection means is a deflection yoke.

20. An assembly according to claim 19, wherein said yoke is disposed between said focusing means and said device.

21. An assembly according to claims 1, 2, 3, 4, 5, 6, 11, 12, 13 or 14, wherein said deflection means is disposed between said focusing means and said device.

22. An assembly according to claims 1, 2, 3, 4, 5, 6, 11, 12, 13 or 14, further including a magnetic shield enclosing said deflection means, said focusing means and said device.

23. An assembly according to claims 1 or 2 employed in a star tracker, wherein said supply means provides a low resolution for said device during a search mode of operation of said tracker and a high resolution for said device during a tracking mode of operation of said tracker.

* * * * *